US006145654A

United States Patent [19]

Loghman

[11] Patent Number: 6,145,654

[45] Date of Patent: Nov. 14, 2000

[54] SPRAY CONTAINER STORAGE AND RETRIEVAL SYSTEM

[75] Inventor: Kamran Loghman, Bethesda, Md.

[73] Assignee: Zarc International, Inc., Bethesda, Md.

[21] Appl. No.: 09/371,504

[22] Filed: Aug. 10, 1999

[51] Int. Cl.[7] ..... A45F 5/00

[52] U.S. Cl. ..... 206/37; 224/674

[58] Field of Search ..... 206/37; 224/148.4, 224/148.5, 148.6, 148.7, 666, 674, 914

[56] References Cited

U.S. PATENT DOCUMENTS

| | | | |
|---|---|---|---|
| 1,453,880 | 5/1923 | Ludwig . | |
| 3,263,806 | 8/1966 | Ring | 206/56 |
| 3,445,046 | 5/1969 | Wilson | 224/26 |
| 5,002,214 | 3/1991 | Caranci | 224/252 |
| 5,009,347 | 4/1991 | Phelps | 224/219 |
| 5,174,482 | 12/1992 | Rogers et al. | 224/239 |
| 5,305,874 | 4/1994 | McLauglin | 206/37 |
| 5,392,975 | 2/1995 | Blankenship, Jr. | 224/253 |
| 5,503,316 | 4/1996 | Stewart | 224/312 |
| 5,531,359 | 7/1996 | Winner | 221/153.11 |

OTHER PUBLICATIONS

Drawing of device sold by assignee of applicant Zarc International, Inc. prior to the filing date of present application.

"CAP–STUN® Standard Leather Holster" illustrations of an additional holster device sold by assignee of applicant Zarc International, Inc.

*Primary Examiner*—Jim Foster

*Attorney, Agent, or Firm*—Liniak, Berenato, Longacre & White, LLC

[57] ABSTRACT

A spray container storage and retrieval system including a holster for receiving a sleeve therein. The sleeve is designed so as to provide an efficient trigger guard for protecting against accidental discharge of spray containers receivable within the sleeve. In certain embodiments, an optional spring may be provided in a lower portion of the sleeve in order to bias the spray container upwardly therefrom when the holster is opened.

8 Claims, 3 Drawing Sheets

SPRAY CONTAINER STORAGE AND RETRIEVAL SYSTEM

This invention relates to an apparatus for enabling an individual to carry a spray container. More particularly, this invention relates to a system and method for carrying a container of spray, such as a self-defense pepper spray or make which enables easy and safe access thereof.

BACKGROUND OF THE INVENTION

Systems for carrying spray containers are old and well known in the art. For example, see U.S. Pat. No. 5,392,975 and U.S. Pat. No. 5,477,999, the disclosures of which are hereby incorporated herein by reference.

The system of U.S. Pat. No. 5,392,975 includes a holster which receives a sleeve therein. The sleeve is elongated and includes a flange extending laterally outward from its upper end to aid in the formation of a trigger guard. Unfortunately, the upper end flange/trigger guard of the '975 patent is undesirable for a number of reasons. For example, the trigger guard is sometimes ineffective in that once the spring within the sleeve forces the spray canister even slightly upwardly, the trigger guard is no longer effective and spray may be accidentally discharged. Additionally, the upper end sleeve flange results in there being no significant protection for a top or upper portion of the spray canister. Yet another disadvantage of the embodiment shown on the cover page of the '975 patent is that the trigger is entirely exposed (e.g. for grabbing by a user) even when the spray canister is within the sleeve and the holster is closed.

It is apparent from the above that there exists a need in the art for an improved system for carrying pepper spray and/or mace canisters which: (i) provides an efficient trigger guard; (ii) provides protection to a top or upper portion of the spray canister; (iii) maintains the spray nozzle in a given direction relative to the sleeve when a substantial or reasonable portion of the canister is in the sleeve; and/or (iv) allows easy access for a user to quickly and efficiently remove the canister from the sleeve and/or holster.

It is a purpose of this invention to fulfill any or all of the above-described needs in the art, as well as other needs which will become apparent to the skilled artisan from the following detailed description of this invention.

SUMMARY OF THE INVENTION

It is an object of this invention to provide a spray container storage and retrieval apparatus/system which enables a user to easily and efficiently access a spray canister housed therein.

Another object of this invention is to provide a spray container storage and retrieval system including a holster for receiving a sleeve therein, wherein the sleeve includes structure which functions as an efficient trigger guard to prevent accidental or incidental discharge of spray from a container disposed in the sleeve.

Another object of this invention is to provide a spray container storage and retrieval system including a holster and corresponding sleeve for receiving a spray canister, wherein the sleeve includes structure for protecting at least a portion of an upper part of the spray canister so as to protect the canister and/or prevent accidental spray discharge therefrom.

Another object of this invention is to provide a sleeve which functions to maintain the spray nozzle in a given direction relative to the sleeve when a substantial or reasonable portion of the canister is in the sleeve.

Yet another object of this invention is to provide a sleeve including a structure which prevents a user from grabbing a substantial portion of a canister spray trigger when the canister is within the sleeve and the holster is in a close position.

Another object of this invention is to satisfy any or all of the above-listed objects.

Generally speaking, this invention fulfills any or all of the above listed objects and/or needs in the art by providing a spray container storage and retrieval apparatus for storing and allowing retrieval of a spray canister including a trigger and spray nozzle, the storage and retrieval apparatus comprising:

a holster defining a cavity therein, the holster including a flap that may be selectively moved between opened and closed positions;

an elongated sleeve including a base at least partially receivable in the cavity of the holster, the sleeve including an upper opening of sufficient size to receive the spray canister so that the canister may be removably provided in the sleeve; and the elongated sleeve further including a wall extending outwardly from a periphery of the base, wherein the wall at least partially supports an elongated channel adapted to receive at least a portion of the trigger of the canister.

This invention will now be described with respect to certain embodiments thereof, along with reference to the accompanying illustrations.

IN THE DRAWINGS

DETAILED DESCRIPTION OF CERTAIN EMBODIMENTS OF THIS INVENTION

Figure 1:
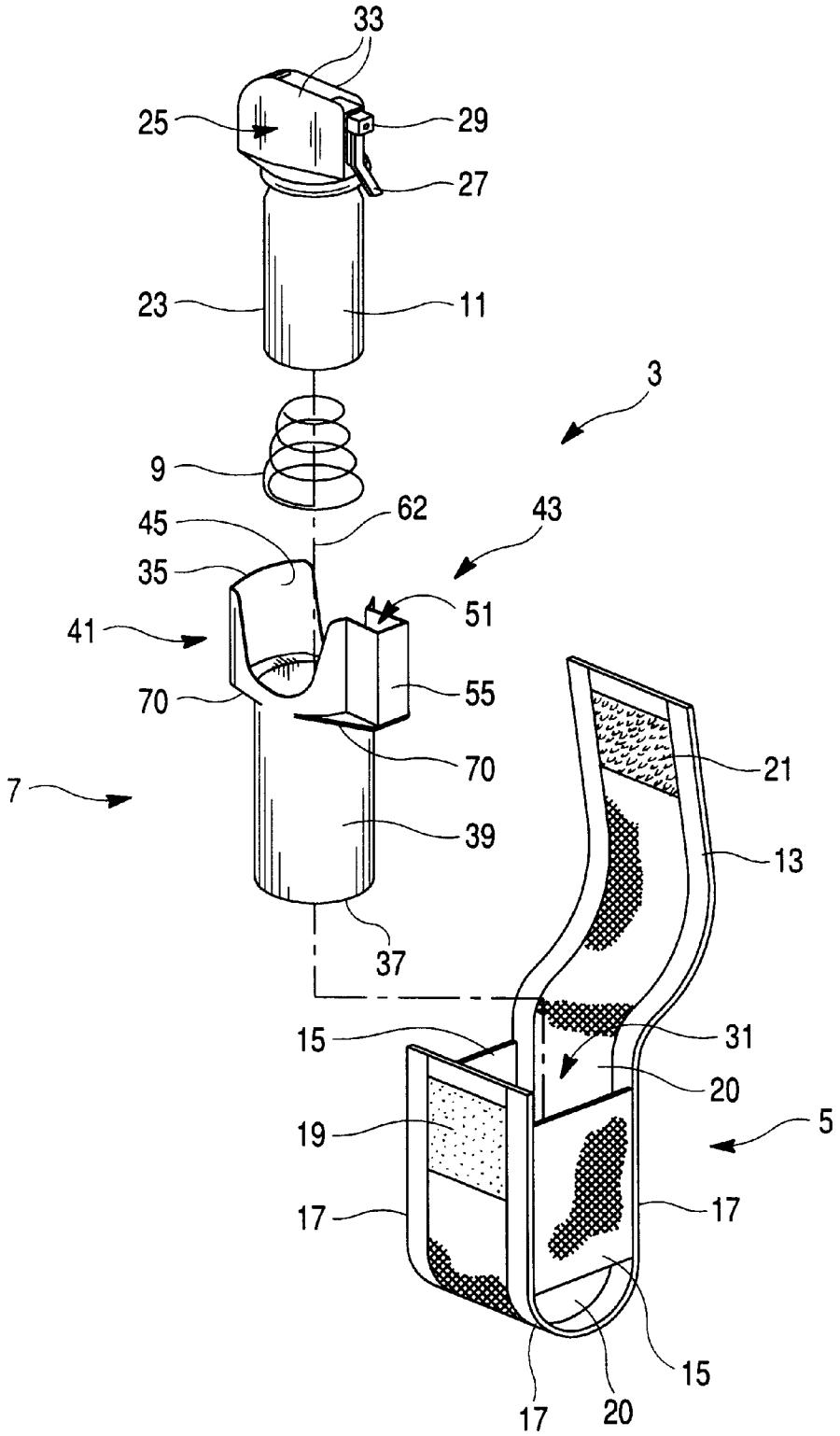
FIG. 1 is an exploded view of a spray container storage and retrieval apparatus/system according to an embodiment of this invention, including a holster, a sleeve receivable in the holster, an optional spring to be located in the bottom of the sleeve, and a spray canister receivable in the sleeve.

Referring now more particularly to the accompanying drawings in which like reference numerals indicate like parts throughout the several views.

Figure 2:
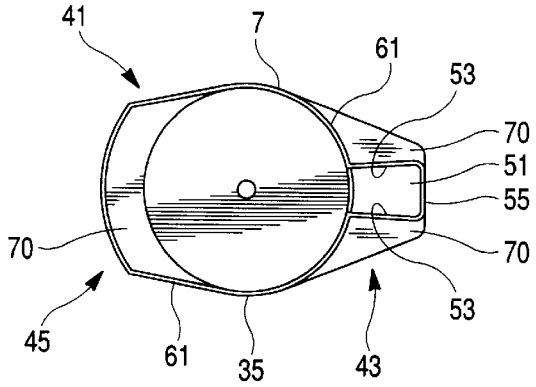
FIG. 2 is a top plan view of the sleeve of FIG. 1.
Figure 3:
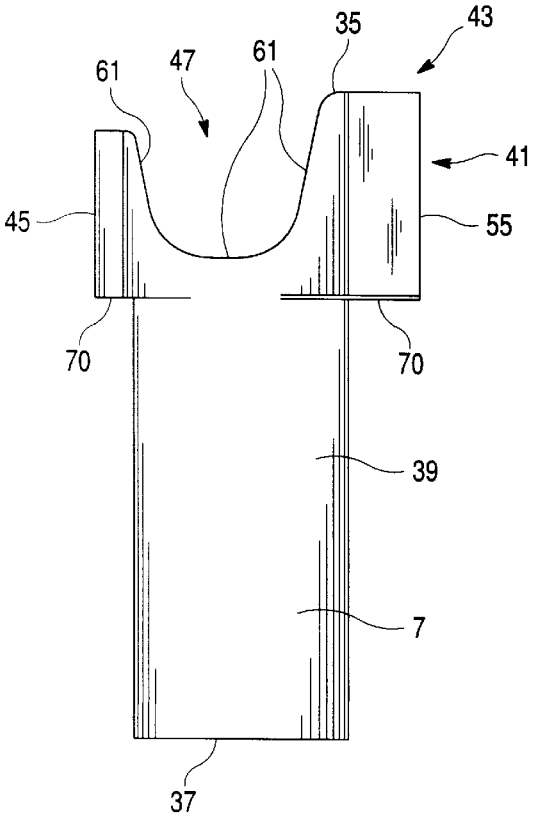
FIG. 3 is a side plan view of the sleeve of FIGS. 1—2.
Figure 4:
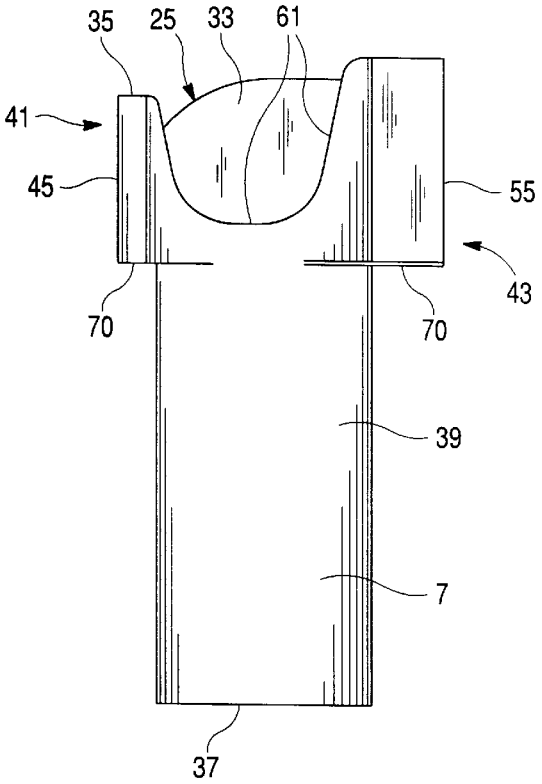
FIG. 4 is a side plan view of the sleeve of FIGS. 1—3 including the spray canister disposed therein.

FIG. 1 is an exploded view of spray container storage and retrieval apparatus/system 3 according to an embodiment of this invention. System 3 includes holster 5, sleeve 7, optional spring 9, and spray canister 11. FIG. 2 is a top view of sleeve 7, while FIG. 3 is a side plan view of sleeve 7. FIG. 4 is a side plan view of sleeve 7 with a canister 11 disposed therein in a position that the canister may assume when the flap of the holster was in a closed position covering the sleeve/canister.

Referring to FIG. 1, holster 5 includes flexible flap 13, first and second approximately parallel side walls 15, and approximately U-shaped bottom portion 17 which is adapted to receive sleeve 7 therein. Side walls 15 extend between and connect opposing upstanding walls of U-shaped portion 17 of holster 5. Hook and loop (e.g. Velcro™) male 19 and female 21 fasteners (or vice versa), are provided so as to enable the holster to be selectively opened and closed by a user wearing the holster on his/her belt or the like. As illustrated, a fastener is provided on flap 13 and the other fastener on the main body of the holster. When closed, flap 13 is in a downward position so that fasteners 19 and 21 matingly adhere to one another so as to maintain sleeve 7 and canister 11 within cavity 31 of the holster. Instead of the hood and loop closure fasteners, other types of fasteners may instead be utilized (e.g. male and female snaps, buttons, zipper, or the like) in other embodiments of this invention.

When it is desired to remove canister 11 from the holster, the user may simply pull flap 13 upwardly to disconnect fasteners 19, 21 in order to expose and remove canister 11 from sleeve 7 and holster 5. As shown in FIG. 1, holster 3 is not entirely closed, but instead is at least partially open 20 so as to allow air circulation therein/therethrough. In preferred embodiments, the bottom of the holster is at least partially closed to potentially support sleeve 7. However, in alternative embodiments the sleeve may be otherwise supported (e.g. by sleeve walls 70 on top of the holster) and/or the bottom of the holster may be open.

In certain embodiments, holster 5 includes a first piece of flexible material (e.g. canvas, leather, plastic, felt, denim, or the like) that forms flap 13 and U-shaped portion 17. One end of the first piece is folded about itself to form the U-shaped portion, and second and third pieces of like flexible material 15 are connected (e.g. stitched, sewn, glued, or otherwise adhered) to opposing approximately parallel walls of portion 17 to form the holster. Optionally, another elongated piece of like flexible material (not shown) may be sewn or otherwise adhered to the back of the holster to form a belt loop to enable the holster to easily be worn on a user's belt.

While in preferred embodiments all portions of holster 5 are of the same flexible material, it is recognized that different types of material (flexible or non-flexible) may be used for different portions thereof on alternative embodiments.

Referring to FIGS. 1 and 4, spray canister 11 includes a cylindrical metallic base portion 23 as well as a plastic upper grip portion 25, trigger 27, and spray nozzle 29. Grip portion 25 includes opposing approximately parallel side walls 33 which are adapted to be gripped by the user when the user removes and/or inserts the canister from/into sleeve 7. Pivotal trigger 27 extends downwardly from an area below nozzle 29 so as to define an elongated or extended trigger gripping surface. When it is desired to spray mace, pepper spray, or the like from the canister, the user picks the canister up, holds portion 23 in his/her hand, and pulls trigger 27 toward the canister body. Such actuation of the trigger causes the spray to be directed from nozzle 29.

Referring to FIGS. 1–4, sleeve 7 is received in, and removable from, cavity 31 of holster 5. Cavity 31 is defined between at least side walls 15 and the approximately parallel upstanding portions of approximately U-shaped portion 17. Sleeve includes upper end 35 and lower end 37, as well as cylindrical hollow base portion 39 and peripheral protective portion 41. Sleeve 7 is preferably sufficiently rigid and closed to protect canister from damage from impact, sharp objects, and adverse environmental conditions. Base portion 39 is preferably cylindrical in shape as illustrated, but alternatively may be oval, rectangular, triangular, or the like in cross section. In certain embodiments, bottom end 37 of sleeve 7 is completely closed for reasons apparent to those skilled in the art. However, it is contemplated that bottom end 37 of the sleeve may be at least partially or fully open in alternative embodiments of this invention, as illustrated by the small aperture provided in the bottom of the sleeve in FIG. 2.

Still referring to FIGS. 1–4, protective portion 41 of sleeve 7 includes: trigger guard and canister retaining portion 43, arcuate or partially cylindrical wall 45 for protecting the rear of canister 11, and first and second coaxial approximately U-shaped wall portions or recesses 47 disposed between portion 43 and wall 45.

Portion 43 includes elongated upstanding hollow channel 51 adapted to receive trigger 27 of the canister therein when the canister is in the sleeve and flap 13 of holster 5 is closed thereover. Vertically upstanding side walls 53 of channel 51 limit or substantially prevent rotation of canister 11 within the sleeve (i.e. the trigger is prevented from moving laterally to any significant extent by side walls 53), thereby maintaining cannister 11 and its spray nozzle 29 in a given pointing direction relative to the sleeve when a substantial or reasonable portion of the canister is in the sleeve (i.e. when a portion of trigger 27 is in any part of channel 51). Vertically extending front wall 55 is approximately perpendicular (i.e. 90 degrees plus/minus about 25 degrees) to side walls 53 and covers a substantial portion of trigger 27 (e.g. see FIG. 4) so as to prevent a user from grabbing a substantial portion of trigger 27 when the canister is within the sleeve and the holster is in a closed position. In certain embodiments of this invention, exemplified by FIG. 4, a substantial portion of trigger 27 is covered up and not exposed to user touching when the sleeve and canister are being carried in a normal manner within closed holster 5. In certain embodiments, walls 53 and 55 of channel extend upwardly to an extent from cylindrical sleeve portion 39 to sufficient extent so as to cover at least about 30 of trigger 27 when the canister is in sleeve 7 and flap 13 of holster 5 is closed thereover (more preferably to cover at least about 60 of trigger 27, and most preferably to cover the entire trigger 27). As a result the trigger 27 is automatically locked and unlocked by respectively inserting or withdrawing it from the channel 51.

While channel 51 is approximately rectangular in cross section in the illustrated embodiments herein (e.g. see FIG. 2), it is contemplated that the channel may instead have a triangular, oval or circular cross section in alternative embodiments of this invention. In preferred embodiments, channel 51 is open at both ends thereof so as to allow the trigger to be removably inserted thereinto and removed therefrom, and also to allow long or lower trigger portions to extends outwardly from the bottom thereof to a position below horizontal wall 70.

In embodiments absent spring 9, when flap 13 is opened canister 11 is in the position shown in FIG. 4 and the user may pull it out of the holster and sleeve by gripping walls 33 and lifting the canister. However, in embodiments where spring 9 is provided at the bottom of sleeve 7, when flap 13 is opened the spring biases or pushes the canister upward so as to cause the top of canister 11 to protrude from about 0.1 to 2.0 inches above top end 35 of sleeve so that it may easily be grabbed by the user and withdrawn from sleeve 7 for use. In spring 9 inclusive embodiments, when canister 11 is in sleeve 7, and flap 13 is closed, the flap closure maintains the canister at least partially in the cylinder against the biasing force of the spring in a position similar to that shown in FIG. 4 (or FIG. 5).

Channel 51 side walls 53 are connected to (e.g. integrally formed with by way of injection molding of plastic) partially cylindrical and/or arcuate walls 61. Vertically upstanding walls 61 are at least partially coaxial (about normally vertical axis 62) and extend between and connect channel 51 and protective wall 45. Walls 61 also define approximately U-shaped recesses 47 which expose for user gripping side walls 33 of spray canister 11.

Arcuate wall 45 is integrally formed with (e.g. injection molding process) walls 53, 55 and 61, and functions to protect the rear portion of canister 11 from damage when in closed holster 5. In certain embodiments, wall 45 extends upwardly from base 39 from about 40% to 90% of the distance that channel wall 55 extends upwardly from base 39. The top of base 39 is defined by horizontally extending bottom walls 70 of protective portion 41. Walls 70 extend outwardly from the periphery of cylinder base 39 and around channel walls 53 on both sides thereof to support and protect the channel walls. In a similar manner, wall 70 on the rear side of sleeve 7 extends outwardly from the periphery of base 39 to support wall 45.

Figure 6:
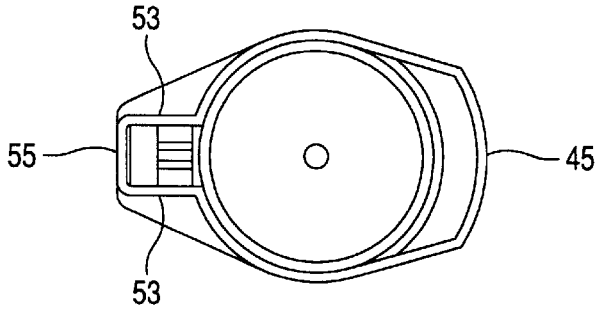
FIG. 6 is a top plan view of the FIG. 5 embodiment.
Figure 5:
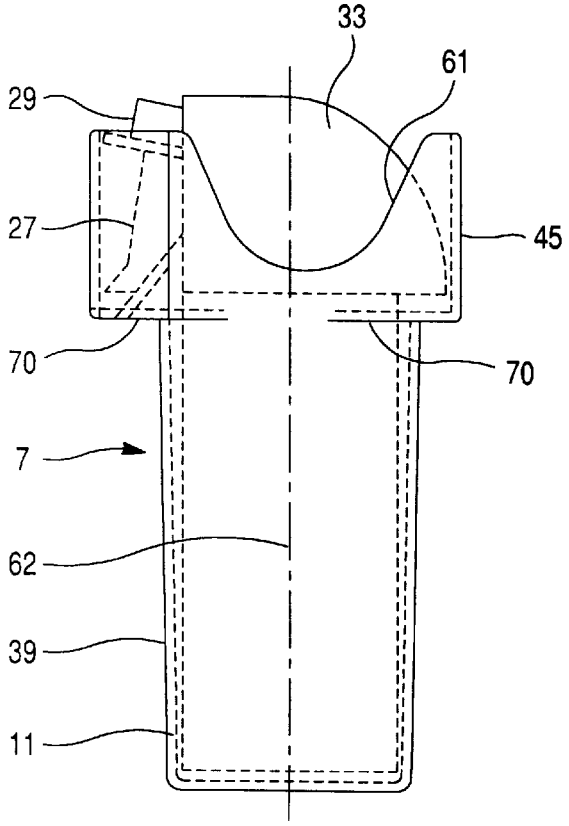
FIG. 5 is a side plan view of a spray container storage and retrieval apparatus/system according to another embodiment of this invention, the system including the illustrated sleeve and spray canister receivable in a holster of a type shown in FIG. 1.
Figure 7:
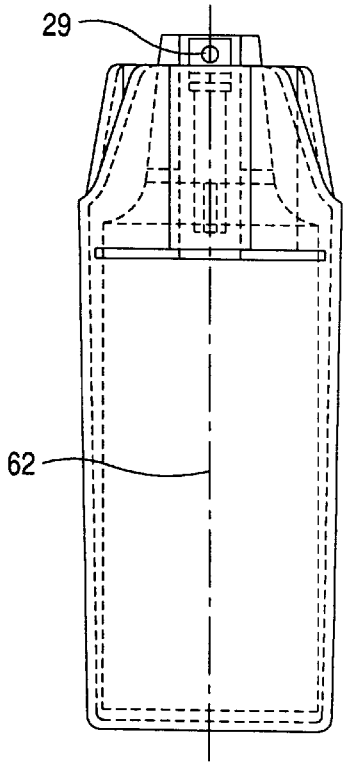
FIG. 7 is a front plan view of the embodiment of FIGS. 5—6.

FIGS. 5–7 illustrate a sleeve 7 and canister 11 according to another embodiment of this invention. This embodiment is similar to the embodiment of FIGS. 1–4, with the exception that wall 45 extends approximately the same height from walls 70 as the channel walls 53, 55. Other differences are also illustrated, such as sleeve 7 being designed so that the top of spray canister 11 extends to a height above the top end of the sleeve when the canister is in the sleeve.

Once given the above disclosure, many other features, modifications, and improvements will become apparent to the skilled artisan. Such other features, modifications, and improvements are, therefore, considered to be a part of this invention, the scope of which is to be determined by the following claims.

I claim:

1. A spray container storage and retrieval apparatus for storing and allowing retrieval of a spray canister including a trigger and spray nozzle, the storage and retrieval apparatus comprising:

a holster defining a cavity therein, said holster including a flap that may be selectively moved between opened and closed positions;

an elongated sleeve including an approximately cylindrical elongated base portion receivable in said cavity of said holster, said sleeve including an upper opening proximate a top end thereof of sufficient size to receive the spray canister; and said elongated sleeve further including a first approximately horizontal wall extending outwardly from an upper portion of said base portion, and wherein said first approximately horizontal wall supports a vertically extending elongated channel extending upwardly therefrom and open to the interior of said sleeve, said elongated channel adapted to receive at least a portion of the trigger of the canister in order to minimize incidental spraying from the canister.

2. The storage and retrieval apparatus of claim 1, wherein said channel is approximately rectangular in cross section and extends to a height above said first horizontal wall sufficient to cover at least about 60% of the trigger of the canister.

3. The storage and retrieval apparatus of claim 2, wherein said channel extends to a height above said first horizontal wall sufficient to cover the entire trigger of the canister.

4. The storage and retrieval apparatus of claim 1, wherein said holster includes a flexible approximately U-shaped portion integrally formed with said flap, and first and second side walls extending between and connecting first and second respective upstanding walls of said approximately U-shaped portion.

5. The storage and retrieval apparatus of claim 1, wherein said sleeve further includes a second approximately horizontal wall approximately co-planar with said first approximately horizontal wall, and wherein said second approximately horizontal wall supports an arcuate protective wall extending upwardly therefrom to a height sufficient to protect a rear portion of the canister housed within the sleeve and holster.

6. The storage and retrieval apparatus of claim 1, further including a spring disposed at a bottom portion of said sleeve for providing an upward biasing force to bias the canister at least partially up and out of said sleeve when said flap is in an opened position.

7. The storage and retrieval apparatus of claim 1, wherein said channel includes first and second approximately parallel side walls and a front wall that is approximately perpendicular to said side walls, and wherein said first and second side walls of said channel intersect with said first approximately horizontal wall and function to prevent substantial rotation of the canister when the canister is in the sleeve.

8. A spray container storage and retrieval apparatus for storing and allowing retrieval of a spray canister including a trigger and spray nozzle, the storage and retrieval apparatus comprising;

a holster defining a cavity therein, said holster including a flap that may be selectively moved between opened and closed positions;

an elongated sleeve including a base at least partially receivable in said cavity of said holster, said sleeve including an upper opening of sufficient size to receive the spray canister so that the canister may be removably provided in said sleeve; and said elongated sleeve further including a wall extending outwardly from a periphery of said base, wherein said wall at least partially supports an elongated channel open to the interior of said sleeve and adapted to receive at least a portion of the trigger of the canister.

* * * * *